US005169323A

United States Patent [19]

Kawai et al.

[11] Patent Number: 5,169,323

[45] Date of Patent: Dec. 8, 1992

[54] MULTIPLEPOLE ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 715,388

[22] Filed: Jun. 14, 1991

[30] Foreign Application Priority Data

Sep. 13, 1990 [JP] Japan ..... 2-241290

[51] Int. Cl.[5] ..... H01R 4/66

[52] U.S. Cl. ..... 439/95; 439/108

[58] Field of Search ..... 639/95, 609, 108, 608, 639/620

[56] References Cited

U.S. PATENT DOCUMENTS 3,678,445 8/1982 Brancaleone ..... 439/609

4,428,639 1/1984 Hillis ..... 439/609

4,738,628 4/1988 Rees ..... 439/95

*Primary Examiner*—Eugene F. Desmond

*Attorney, Agent, or Firm*—Kanesaka & Takeuchi

[57] ABSTRACT

A multiple pole electrical connector includes a cylindrical metal shell (6); and insulation housing (7) placed within the metal shell and having a plurality of ground member recesses (20) formed on its circumferential surface; a plurality of detachable terminals (8) supported by the insulation housing, one of the detachable terminals serving as a ground terminal (9); and a detachable ground member (23) mounted on the ground terminal with a shell contact portion (24) thereof fitted in the ground member recess such that when the insulation housing is placed within the metal shell, the shell contact portion comes into close contact with an inside of the metal shell.

5 Claims, 6 Drawing Sheets

MULTIPLEPOLE ELECTRICAL CONNECTOR

BACKGROUND OF THE INVENTION

1. Field of the Invention

The present invention relates to electrical connectors and, more particularly, to multiple pole electrical connectors for use in electrical or electronic equipment.

2. Description of the Prior Art

A conventional electrical connector of this type is shown in FIGS. 16 and 17. A connector block 53 includes a cylindrical shell 54 made from a metal, an insulation housing 55 placed within the metal shell 54 and made from an insulator, and four terminals 56 supported by the insulation housing 55. The front end of the cylindrical shell 54 is joined with a front shell 57 which is inserted into the shell of a receptacle. One of the terminals 56 is used as a ground terminal 56*a* to which a ground spring contact 59 is attached with a screw 58 so that the end portion of the ground contact 59 comes into contact with the inside wall 60 of the front shell 57.

In the conventional electrical connector, once the ground terminal 56*a* is determined, it is impossible to use the other terminals 56 as ground terminals. However, the position of the ground terminal 56*a* varies from customer to customer. Consequently, it is necessary to make a variety of types of multiple pole electrical connectors to meet the requirements of various customers, thus increasing the unit manufacturing costs.

SUMMARY OF THE INVENTION

Accordingly, it is an object of the invention to provide a multiple pole electrical connector which permits mounting a ground terminal in any terminal aperture of the insulator housing to meet a variety of uses, thus reducing the unit manufacturing costs.

According to the invention there is provided a multiple pole electrical connector which includes a cylindrical metal shell; an insulation housing placed within the metal shell and having a plurality of ground member recesses formed on its circumferential surface; a plurality of detachable terminals supported by the insulation housing, one of the detachable terminals serving as a ground terminal; and a detachable ground member mounted on the ground terminal with a shell contact portion thereof fitted in the ground member recess such that when the insulation housing is placed within the metal shell, the shell contact portion comes into close contact with an inside of the metal shell.

With the multiple pole electrical connector according to the invention, it is possible to mount the ground terminal with the ground member in any terminal aperture of the insulation housing, whereby a single type of multiple pole electrical connector meets the requirements of various customers, thus reducing the unit manufacturing costs.

The above and other objects, features, and advantages of the invention will be more apparent from the following description when taken in conjunction with the accompanying drawings.

DESCRIPTION OF THE PREFERRED EMBODIMENT

Figure 1:
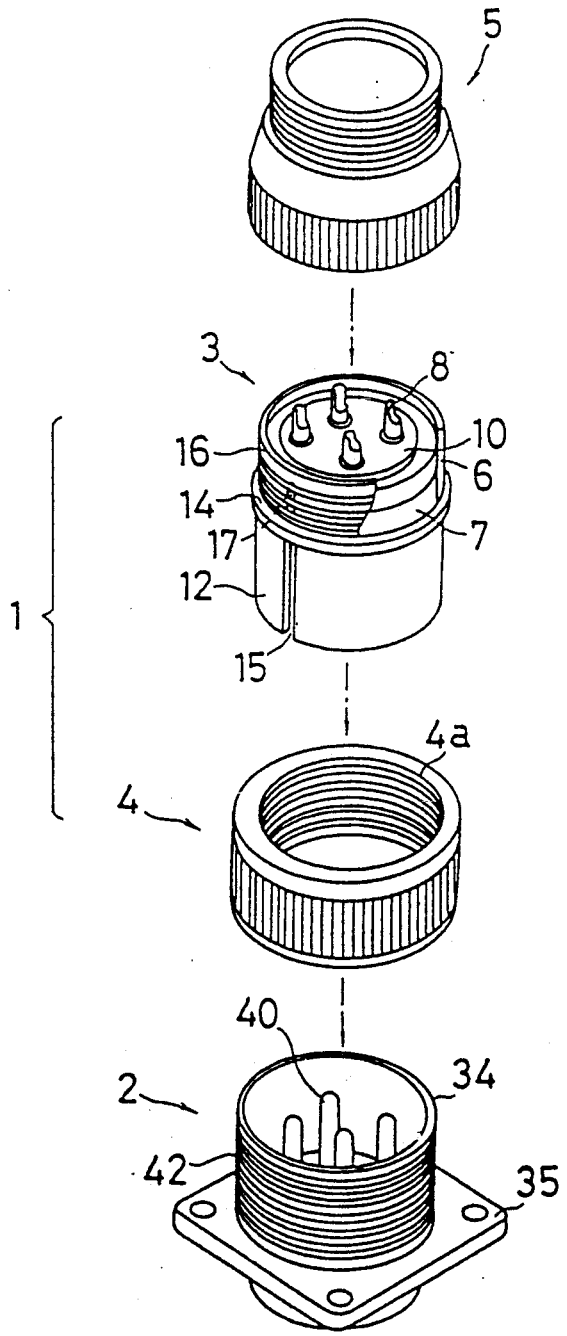
FIG. 1 is an exploded perspective view of a multiple pole electrical connector according to an embodiment of the invention.

In FIG. 1, the multiple pole electrical connector consists of a multiple pole electrical plug 1 and a multiple pole electrical receptacle 2. The plug 1 includes a connector block 3, a coupling sleeve 4, and a cord sleeve 5. The connector block 3 includes a cylindrical metal shell 6, an insulation housing 7 placed within the metal shell 6.

Figure 2:
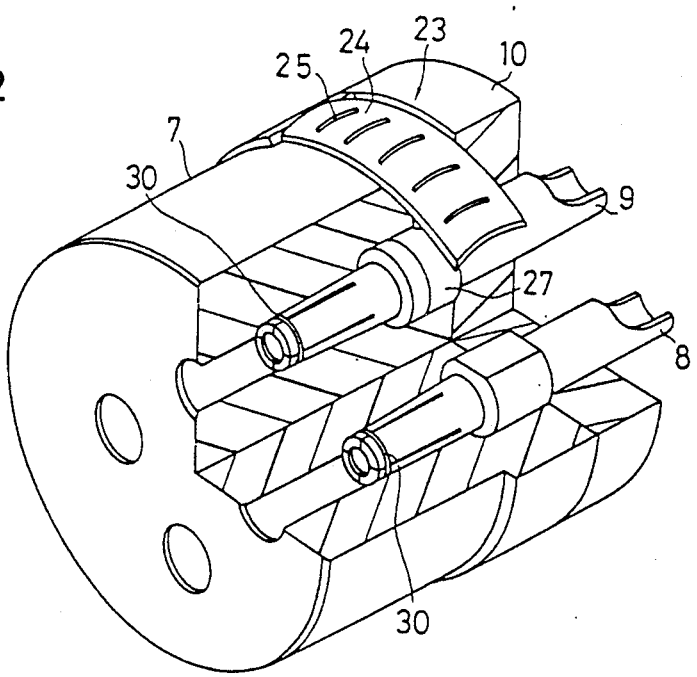
FIG. 2 is a partially cutaway perspective view of an insulation housing for use in the multiple pole electrical connector.

In FIG. 2, the insulation housing 7 has three female terminals 8, one ground terminal 9, a ground member 23 attached to the ground terminal 9, and a retention member 10 for holding the terminals 8 and 9 in place in the insulation housing 7.

Figure 15:
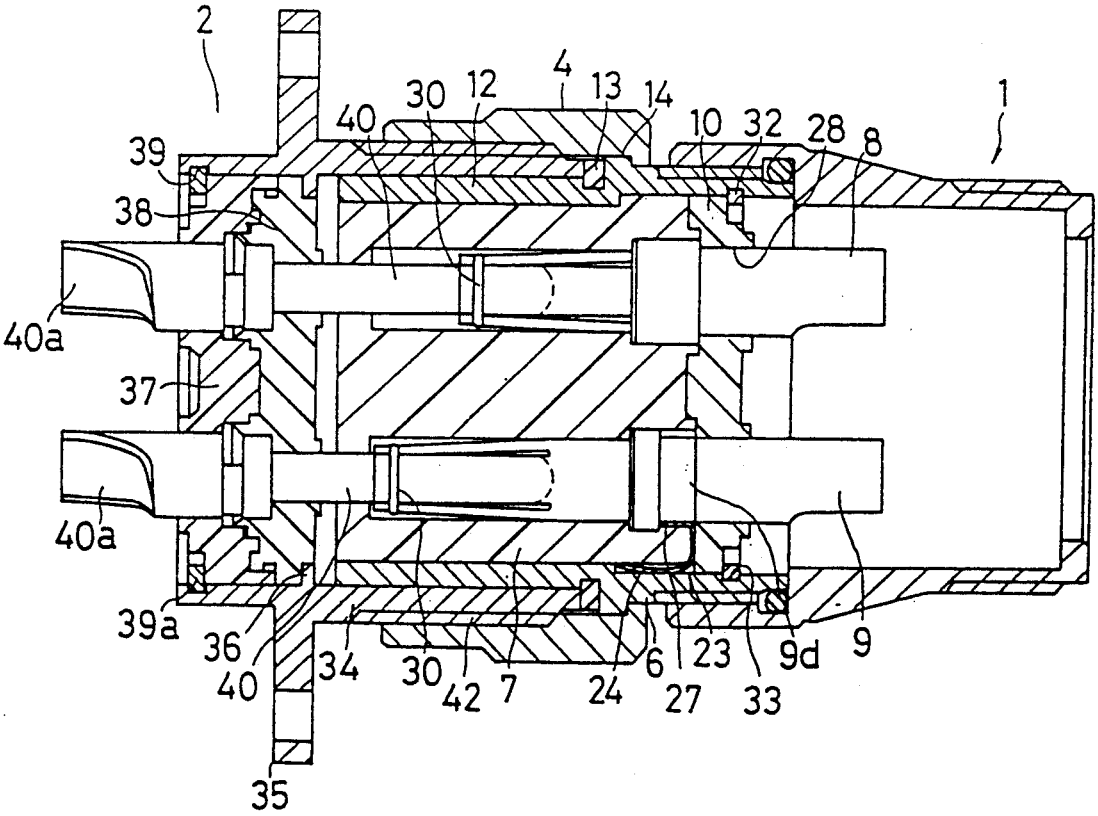
FIG. 15 is a longitudinal section of the multiple pole electrical connector in connection with a mating electrical connector.
Figure 3:
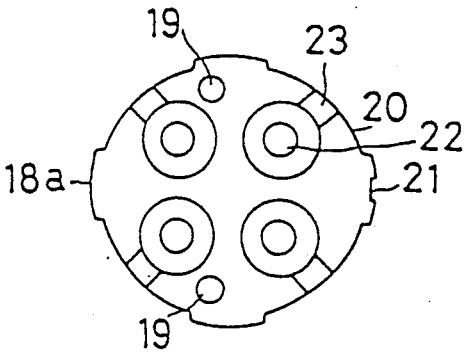
FIG. 3 is a rear view of the insulation housing.
Figure 4:
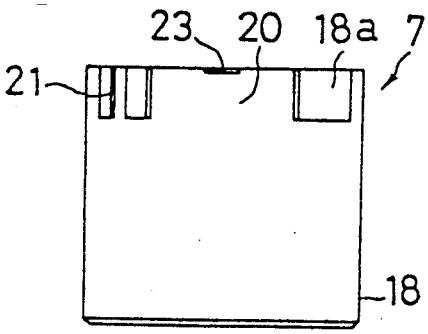
FIG. 4 is an elevational view thereof.
Figure 5:
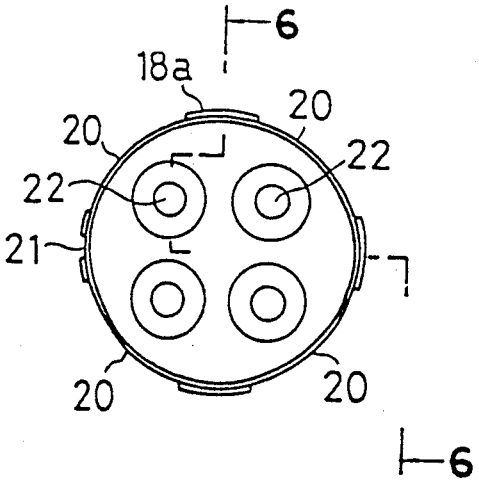
FIG. 5 is a front view thereof.
Figure 6:
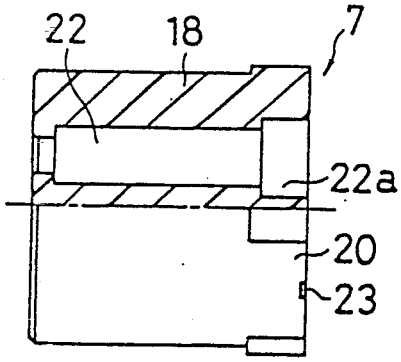
FIG. 6 is a partially cutaway side elevational view taken along line 6—6 of FIG. 5.

Referring back to FIG. 1, the metal shell 6 is made substantially in the form of a cylinder and has a connection portion 12 to be inserted into the receptacle shell 34 of the receptacle 2 and an external flange 14 for stopping the coupling sleeve 4 and a packing 13 (FIG. 15). The connection portion 12 has a guide slit 15 extending in the axial direction. The metal shell 6 has an exterior thread portion 16 behind the external flange 14, with the interior having a guide ridge 17 extending in the axial direction.

In FIGS. 3–6, the insulation housing 7 has a housing block 18 made from a synthetic resin in the form of a cylinder. The housing block 18 has an enlarged rear portion 18*a* with four ground member recesses 20 spaced at equal intervals and a guide channel 21. Also, it has four terminal apertures 22 spaced at equal intervals and placed on the line including the midpoint of the ground member recess 20 and the center of the housing block 18. Each terminal aperture 22 has an enlarged rear portion 22*a*. Four channels 23 formed between the ground member recess 20 and the terminal aperture 22 and two positioning holes 19 are provided on the rear end surface of the housing block 18.

Figure 7:
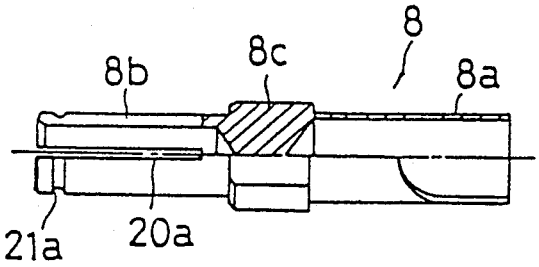
FIG. 7 is a partially cutaway side elevational view of a female terminal for use in the multiple pole electrical connector.

In FIG. 7, the female terminal 8 has a cord connection portion 8*a*, a terminal contact portion 8*b*, and an enlarged intermediate portion 8*c*. The terminal contact portion 8*b* has four slits 29*a* extending in the axial direction and a annular groove 21*a* on its front end portion.

Figure 8:
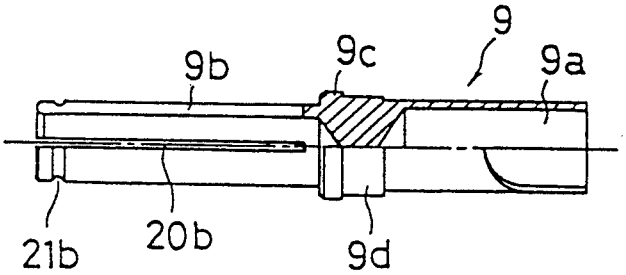
FIG. 8 is a partially cutaway side elevational view of a ground terminal for use in the multiple pole electrical connector.

In FIG. 8, the ground terminal 9 has a cord connection portion 9*a*, a terminal contact portion 9*b*, and an enlarged intermediate portion 9*c* which has a stepped down ground member attachment portion 9*d*. The terminal contact portion 9*b* has four slits 20*b* extending in the axial direction and an annular groove 21*b* on its front end portion.

Figure 9:
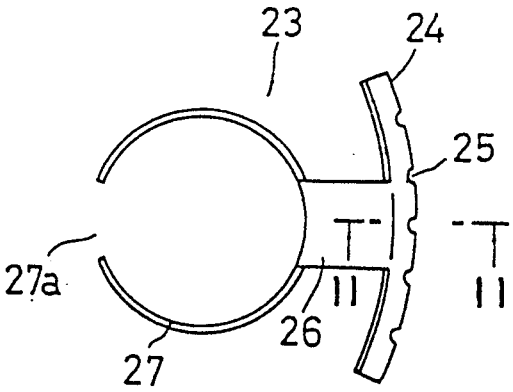
FIG. 9 is a top plan view of a ground member to be fitted over the ground terminal.
Figure 10:
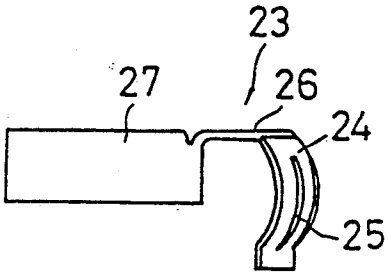
FIG. 10 is a side elevational view of the ground member.
Figure 11:
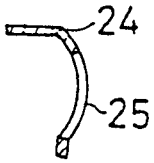
FIG. 11 is a sectional view taken along line 11—11 of FIG. 9.

In FIGS. 9–11, the ground member 23 has a shell contact portion 24 which is made by bending a comb-like metal sheet in the form of an arc such that the shell contact portion 24 has a number of slits 25 spaced along the length. The shell contact portion 24 is made integral with an attachment portion 27 via a linkage portion 26. The attachment portion 27 is made in the form of a ring with a discontinued portion 27*a*.

Figure 12:
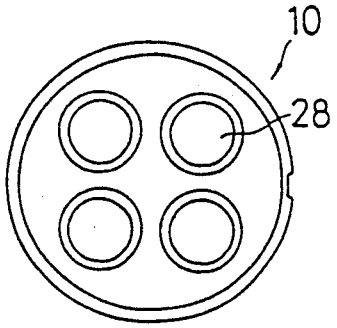
FIG. 12 is a rear view of a retention member for holding the female terminals in place in the insulation housing.
Figure 13:
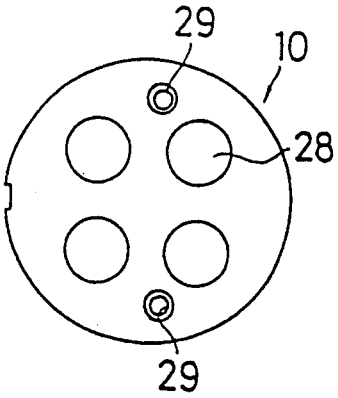
FIG. 13 is a front view of the retention member.
Figure 14:
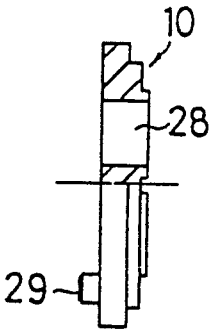
FIG. 14 is a partially cutaway side elevational view of the retention member.
Figure 16:
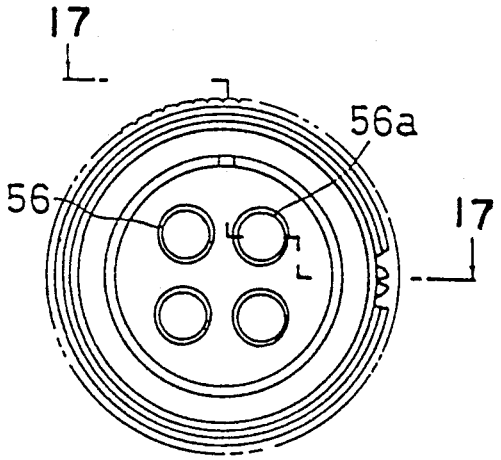
FIG. 16 PRIOR ART
FIG. 16 is a front view of a conventional multiple pole electrical connector.
Figure 17:
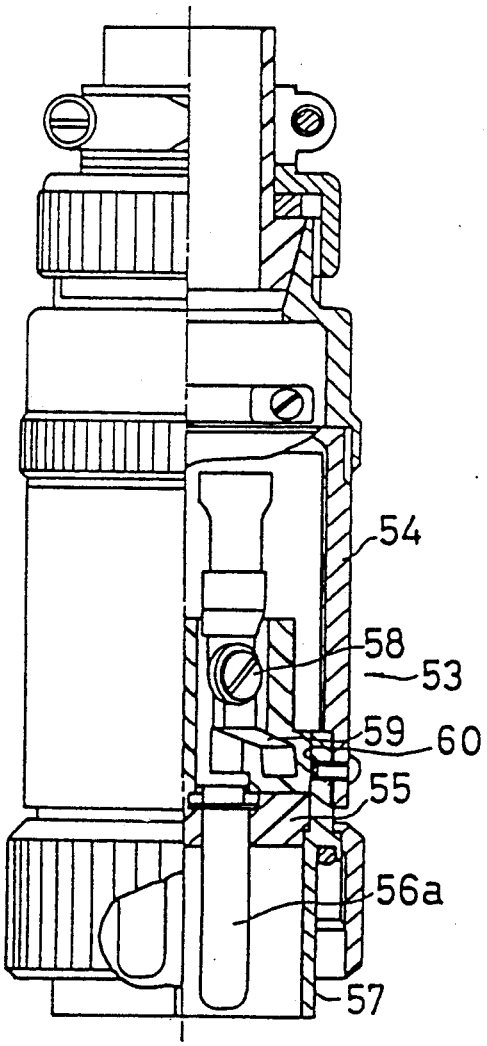
FIG. 17 PRIOR ART
FIG. 17 is a partially cutaway side elevational view taken along line 17—17 of FIG. 16.

In FIGS. 12–14, the retention member 10 is made from a synthetic resin in the form of a disc having four terminal apertures 28 spaced at equal intervals and two positioning pins 29 projecting forwardly from its front surface.

In FIG. 15, a wrap spring 30 is put on each of the annular grooves 21*a* and 21*b* of the terminals 8 and 9, and the ground member 23 is fitted over the attachment portion 9*d* of the ground terminal 9. The three female terminals 8 and the ground terminal 22 are then mounted in the terminal apertures 22 of the insulation housing 7 such that the shell contact portion 24 and the linkage portion 26 fit in the ground member recess 20 and the channel 23, respectively. The insulation housing 7 is then inserted into the metal shell 6 such that the guide ridge 17 of the metal shell 6 fits in the guide channel 21 of the insulation housing 7 for positioning. When the insulation housing 7 is placed within the metal shell 6, the shell contact portion 24 of the ground member 23 is in close contact with the inside of the metal shell 6. The contacting force is so strong that the the shell contact portion 24 breaks the lacquer coating over the metal shell 6 and comes into direct contact with the metal shell 6, establishing an electrical connection. Then, the retention member 10 is fitted into the metal shell 6 such that the cord connection portions 8*a* and 9*a* of the female terminals 8 and the ground terminal 9 go through the terminal apertures 28. Then, a stop ring 32 is fitted into an annular groove 33 formed on the inside of the metal shell 6 to hold the retention member 10 and thus the insulation housing 7 within the metal shell 6. This completes the assembling of the connector block 3.

The coupling sleeve 4 is fitted over the connector block 3 for rotation such that the inner flange 4*a* engages the external flange 14 of the metal shell 6. The cord sleeve 5 is threaded over the rear portion 16 of the metal shell 6 after each cord connection portion 8*a* or 9*a* of the terminals 8 and 9 is soldered to a cord (not shown).

The receptacle 2 includes a cylindrical receptacle shell 34 with a mounting flange 35 extending outwardly and a stopper flange 36 extending inwardly. A terminal support 37 and a waterproof packing 38 are fitted into the rear portion of the receptacle shell 34 up to the stopper flange 36 and held in place by a stopper ring 39*a* which is fitted in an annular groove 39. Four male terminals 40 are planted in the terminal support 37 at equal intervals so that the contact portion project forwardly from the waterproof packing 38 while the cord connection portion 40*a* project rearwardly from the terminal support 37. Each cord connection portion 40*a* of the male terminals 40 is soldered to a cord (not shown).

In operation, the receptacle 2 is attached to electrical or electronic equipment (not shown) by screwing the mounting flange 35. As FIG. 15 shows, the connection portion 12 of the plug shell 6 is inserted into the receptacle shell 34 of the receptacle 2 so that the male terminals 40 are inserted into the female terminals 8 for establishing an electrical connection. In this respect, the guide ridge of the receptacle shell 34 is inserted in the guide slot 15 of the plug shell 6 for guidance. Then, the coupling sleeve 4 is threaded over the front portion 42 of the receptacle shell 34 to connect the plug 1 to the receptacle 2. As a result, the ground terminal 9 is grounded to the electronic equipment via the ground member 23, the plug shell 6, and the receptacle shell 34.

With the multiple pole electrical connector according to the invention, it is possible to mount the ground terminal 9 in any terminal aperture 22 of the insulation housing 7, with the ground member 23 fitted over the ground terminal 9. When the insulation housing 7 is placed within the plug shell 6, the shell contact portion 24 of the ground member 23 breaks the lacquer coating and comes into direct contact with the plug shell 6. Thus, the multiple pole electrical connector is useful for a variety of applications, thus reducing the unit manufacturing costs.

We claim:

1. A multiple pole electrical connector comprising:

a cylindrical metal shell;

an insulation housing placed within said metal shell and having a plurality of ground member recesses formed on its circumferential surface a plurality of terminal apertures; and a plurality of channels formed on a rear end surface thereof to connect said ground member recesses and said terminal apertures;

a plurality of detachable terminals having an enlarged intermediate portion inserted into said terminal apertures of said insulation housing, one of said detachable terminals serving as ground terminal; and a detachable ground member mounted on said ground terminal with a shell contact portion thereof fitted in said ground member recess and a linkage portion thereof fitted in one of said channels such that when said insulation housing is placed within said metal shell, said shell contact portion comes into close contact with an inside of said metal shell.

2. The multiple pole electrical connector of claim 1, wherein said shell contact portion has a curved comb-like shape.

3. The multiple pole electrical connector of claim 1, wherein said terminal apertures have an enlarged rear portion for receiving said enlarged intermediate portion of a detachable terminal.

4. The multiple pole electrical connector of claim 1, wherein said ground member further comprises a ring-shaped attachment portion to be fitted over a stepped down ground member attachment portion of said ground terminal.

5. A multiple pole electrical connector comprising:

a cylindrical metal shell;

a cylindrical dielectric housing placed within said metal shell and having a plurality of terminal apertures extending therethrough and having an enlarged intermediate portion, a plurality of ground member mounting recesses formed on a circumferential surface thereof, and a plurality of linkage channels formed on said rear end surface thereof to connect said terminal apertures to said mounting recesses;

a plurality of signal terminals each having a first enlarged intermediate portion fitted in one of said enlarged rear portions of said terminal apertures;

a ground terminal having a second enlarged intermediate portion which has a diameter substantially equal to that of said first enlarged intermediate portion, except a stepped down rear portion, so that said ground terminal is able to be inserted any of said terminal apertures; and a ground member having a ring-like portion to be fitted over said stepped down rear portion of said ground terminal, a comb-like contact portion to be mounted in one of said mounting recesses, and a linkage portion fitted in one of said linkage channels and connecting said comb-like contact portion to said ring-like attachment portion.

* * * * *